US012453391B1

(12) United States Patent
Flanagan

(10) Patent No.: US 12,453,391 B1
(45) Date of Patent: Oct. 28, 2025

(54) TOPLESS SHOES

(71) Applicant: Timothy Flanagan, Hazlet, NJ (US)

(72) Inventor: Timothy Flanagan, Hazlet, NJ (US)

( * ) Notice: Subject to any disclaimer, the term of this patent is extended or adjusted under 35 U.S.C. 154(b) by 0 days.

(21) Appl. No.: 18/798,507

(22) Filed: Aug. 8, 2024

(51) Int. Cl.
*A43B 3/12* (2006.01)

(52) U.S. Cl.
CPC ..... *A43B 3/122* (2013.01); *A43B 3/12* (2013.01); *A43B 3/126* (2013.01)

(58) Field of Classification Search
CPC ..... A43B 3/12; A43B 3/122; A43B 3/126
USPC ..... 36/11.5, 106
See application file for complete search history.

(56) References Cited

U.S. PATENT DOCUMENTS 1,877,724 A * 9/1932 Gustin ..... A43B 3/12 36/105
2,167,035 A 7/1939 Westheimer
2,208,104 A * 7/1940 Perugia ..... A43B 3/10 36/105
2,985,970 A * 5/1961 Mccarthy ..... A43B 13/00 36/106
4,920,664 A * 5/1990 McGregor ..... A43B 3/126 36/11.5
6,226,893 B1 * 5/2001 Schlamp ..... A43B 3/106 36/94
6,298,580 B1 * 10/2001 Tadayon ..... A43B 7/26 36/94
6,684,442 B1 * 2/2004 Parker ..... A43B 3/106 12/146 B
7,398,607 B1 * 7/2008 Garcia ..... A43B 3/122 36/89
11,129,434 B2 9/2021 Opalacz et al.
11,406,154 B2 8/2022 Fina
2002/0166257 A1 * 11/2002 Wilkinson ..... A43B 7/12 36/3 A
2003/0074806 A1 4/2003 Urie et al.
2003/0217416 A1 11/2003 Litke et al.
2004/0055179 A1 * 3/2004 Wang ..... A43B 3/103 36/8.1
2008/0098617 A1 * 5/2008 Garrett ..... A43B 7/00 36/71
2009/0133289 A1 5/2009 Cantoni
2011/0016745 A1 * 1/2011 Hammerbeck ..... A43B 3/248 36/11.5
2011/0277344 A1 * 11/2011 Berg ..... A43B 3/101 36/11.5
2012/0152267 A1 * 6/2012 Chang ..... A43B 13/04 36/94

(Continued)

OTHER PUBLICATIONS https://shammasandals.com/products/warriorssandals?utm_campaign=&utm_source=google&utm_medium=cpc&utm_term=&gad_source=1&gclid=Cj0KCQjwqpSwBhCIARIsADIZ_TnQ9iZ1uHNTTA8hgk-SLQzOWKIBB6GOJz493FVVyw_WjQif_eWA5YAaAoDAEALw_wcB.
https://www.kurufootwear.com/products/womens-tread-cedarbrown-vanillacreampalekhaki?g_acctid=339-858-5723&g_campaign=Paid+-+Shopping+-+Standard_Non-Brand+%28US%29_G_AQ&g_campaignid=21013886583&g_adgroupid=158523628283&g_adid=690877290917&g_keyword=&g_keywordid=pla-1878023096370&g_adtype=pla&g_merchantid=9974023&g_productchannel=online&g_product.
https://www.aliexpress.us/item/3256802976494458.html?gatewayAdapt=glo2usa4itemAdapt.

*Primary Examiner* — Marie D Bays
(74) *Attorney, Agent, or Firm* — Thompson Patent Law Offices PC

(57) ABSTRACT

The invention relates to foot wear that does not have the traditional coverings or attachments on the front part of the shoe, but instead have the innovative and propriety adjustable side straps 2 between the sole or bottom of the foot ware. In addition, the foot wear has a back strap 1 elevated above the heel level and a top strap 3 crossing over near the wearer's ankle. All the straps are adjustable such as by (Continued)

Velcro, snaps, buckles, and other adjusting and fastening means.

8 Claims, 3 Drawing Sheets

(56) References Cited

U.S. PATENT DOCUMENTS

| | | | | |
|---|---|---|---|---|
| 2013/0326907 | A1* | 12/2013 | Ahanotu | A43B 21/00 36/58.6 |
| 2017/0238646 | A1* | 8/2017 | Newman | A43B 3/122 |
| 2018/0303194 | A1* | 10/2018 | Naughton | A43B 3/122 |

* cited by examiner

TOPLESS SHOES

BACKGROUND OF THE INVENTION

Shoes have been in use for thousands of years to protect human feet from the ground, to keep the foot warm, dry, or otherwise protected from the environment. In addition shoes have been worn to give the wearer firm footing on uneven or even treacherous ground. There are also shoes for hiking or climbing, or even water shoes for going in the water with.

Shoe designers including designers of sandals or slides, continually look for ways to enhance the appeal of shoes to consumers from a functional or aesthetic purpose. Oftentimes shoes have become a fashion statement and entire industries have grown up around the hundreds of thousands of shoe designs that the public has been clamoring for.

The inventor suffered from hammer toes and neuropathy in the ball of the foot and big toe, and the inventor could not find any footwear to alleviate the pain and discomfort. That was the genesis of this entirely new category of innovative footwear

SUMMARY OF THE INVENTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

The bad thing about flip-flops, is they blow out! Now there's Topless Footwear. Topless Footwear never blow out. Toes will love them. It's the closest thing that anyone can get to walking barefoot. It's like wearing an ankle bracelet, and not having shoes on at all. Topless Footwear are also quite sexy. This whole new category of innovative foot ware provides a way to finally show off toes and beautiful feet.

Topless Footwear is known to alleviate hammer toe, and assist those who experience toe pain in all shoes. Topless Footwear is also known to alleviate neuropathy in the foot and toes. Now with Topless Footwear wearers can look cool and their feet and toes will feel great.

Ever try jogging in flip-flops? Orthopedists (Chiropractor) say that Flip Flops hurt your back. People can jog on the beach wearing their Topless Footwears! Topless Footwear are so incredibly lightweight, your feet feel like they're flying naked. Topless Footwear come on and off so easily, and can adjust to fit ankles exactly, and are very popular too. Wearing Topless Footwear to pedicure appointments keeps toes free to dry without smudging. Topless Footwear allow users to move their toes and finally straighten out that hammer toe. Topless Footwear also alleviate sweaty feet.

Topless Footwear minimizes tan lines on feet, boosts healthy circulation and is an aid in caring for injured toes.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION OF THE INVENTION

Figure 1:
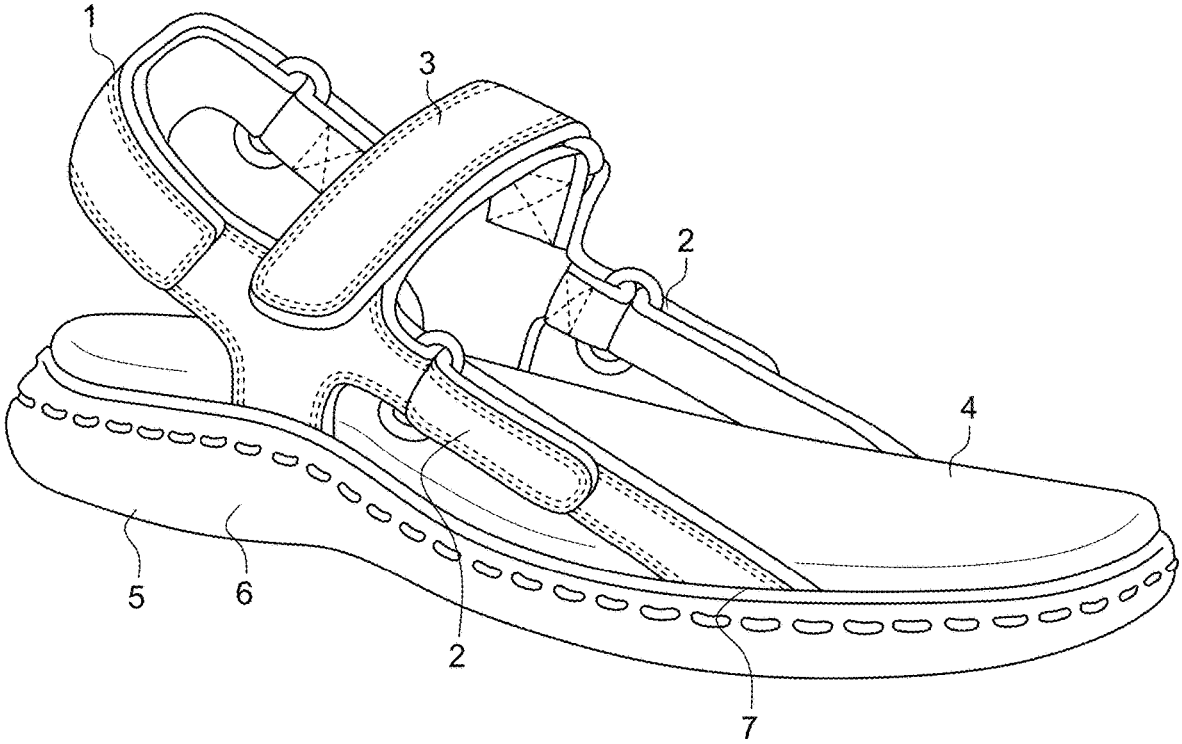
FIG. 1 according to an embodiment of this invention illustrates a drawing of the Topless Footwear foot ware.
Figure 2:
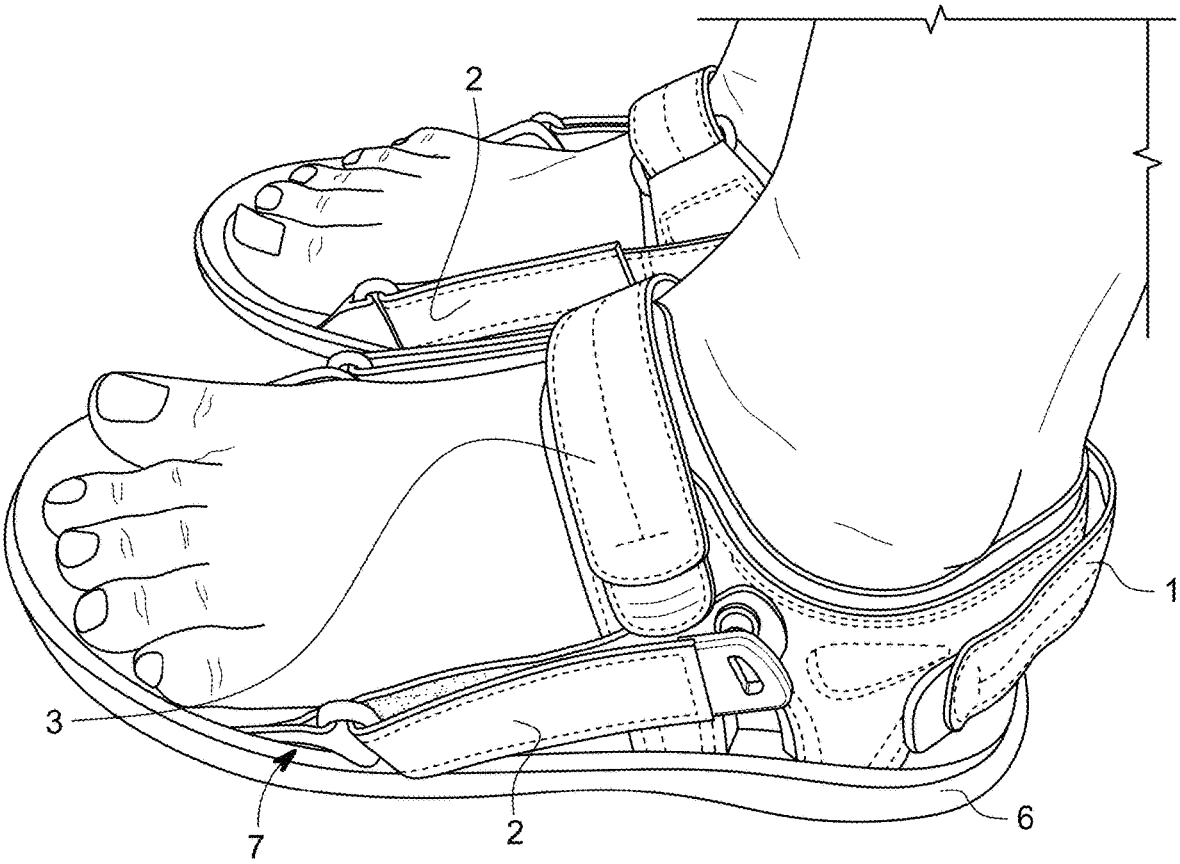
FIG. 2 according to an embodiment of this invention illustrates a side photograph of a person wearing the Topless Footwear, with the entire top of the person's foot exposed.
Figure 3:
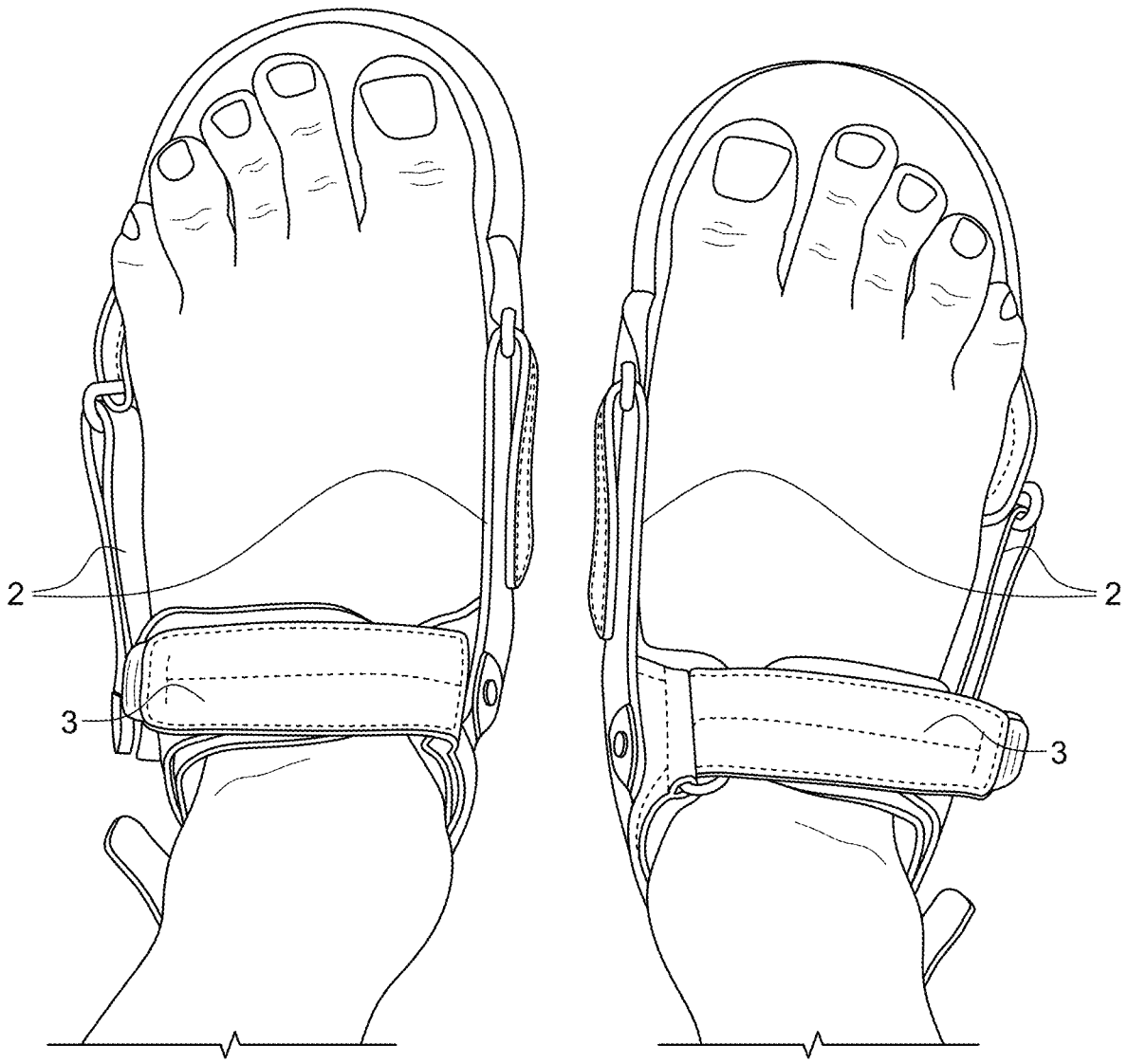
FIG. 3 according to an embodiment of this invention, illustrates a top-down photograph of person wearing the Topless Footwear, with the entire top of the person's foot exposed.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

Topless Footwear are footwear that has no traditional coverings or attachments on the front part of the foot. Topless Footwear are the only footwear designed and made which is attached to the feet only at the back of the foot, where the achilles' is located, and the top part of the foot closest to the ankle. Present are innovative, proprietary and revolutionary "Side Straps" 2 which are adjustable to maintain upward pressure on the sole of the foot ware to the sole of your foot, so that the sole of the foot ware hugs the bottom of your feet without the traditional annoying and uncomfortable straps or webbing over the front part of the foot.

By creating footwear without coverings on the front part of the foot, the toes and front portions of the feet are free of the confinement, squishing, abrasion and discomfort associated with sandals or traditional footwear. The toes and front portion of the foot are free from the disfiguring compression and unhealthy sweatiness of traditional sandals or traditional sneakers. No more annoying, irritation and blisters caused by connections between the big toe and the index toe like flip flops have. No more constricting and compressing coverings of your toes like in sandals, or regular shoes for that matter. The front of your foot and your toes can finally breathe, get a tan and promote healthy circulation. Hammer toes are frequently caused or aggravated by the traditional coverings on the front part of the foot, thus wearing Topless Footwear, the wearer can finally straighten out their hammer toes.

The strap on the upper part of the foot, the "Ankle Strap" 3, and the straps between the Ankle Strap 3 and the sole of the footwear 5 (on the sole in the area of the ball of the foot, on both sides), the "Side Straps" 2 are all infinitely adjustable with Velcro straps or slide buckles or other adjustment method. There is a strap behind the ankle 1, that is connected to "Side Straps" 2 that is connected to the sole below the ankle and at the point the strap behind the ankle 1 turns into Sides Straps 2. The innovative adjustable side straps 2 are also connected to the sole 5 in the area of the ball of the foot. All the straps are adjustable such as by Velcro, snaps, buckles, and other adjusting and fastening means.

The uppers of the Topless Footwear 1/2/3 are made of leather, synthetic leather and/or other desirable materials. The soles 6 of the Topless Footwear, are made of synthetic or natural material with possible antimicrobial properties contacting the foot. The sole bottoms 5 contacting the ground are made of synthetic rubber or other materials for light-weight comfort and extended wear.

The uppers of the Topless Footwear, that are separately designed for beach goers, are made of nylon & polyester blend woven materials, still with the same general overall design, including Velcro and/or or slide buckles or other adjustment method, but dry quickly without retaining moisture.

The uppers of the Topless Footwear, that are designed for more fashionable occasions, are made with leather or other high quality materials, with snaps, or belt buckles or other adjusting materials/mechanisms replacing the Velcro or other adjustment method.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . "

The invention claimed is:

1. A topless shoe comprising:

a sole extending along a longitudinal direction from a heel portion to a toe portion and defining a lateral side and a medial side;

converging sections positioned along opposing sides of the sole between the heel and toe portion extending from midsection sole anchors;

a releasable strap behind the ankle extending rearwardly to couple opposing ends of the rear parts of the converging sections;

opposing adjustable side straps extending rearward from toe anchor points proximate to the toe portion to the converging sections; and, a releasable ankle strap extending to couple the opposing converging sections;

wherein the opposing adjustable side straps loop from the converging sections to fastener portions of the adjustable side straps are configured such that the opposing adjustable side straps tighten by pulling on the adjustable side straps after looping through the converging section and remain in tension by coupling the adjustable side straps to the fastener portions of the adjustable side straps.

2. The topless shoe of claim 1, wherein the ankle strap loops from the converging sections to define a receiving portion and a coupling portion, wherein the ankle strap is configured such that the ankle strap tightens by pulling on the ankle strap after looping through the converging section and remain in tension by coupling the coupling portion to the receiving portion.

3. The topless shoe of claim 1, wherein the strap behind the ankle loop from the converging sections to fastener portions of the strap behind the ankle are configured such that the strap behind the ankle tightens by pulling on the strap behind the ankle after looping through the converging section and remain in tension by coupling the strap behind the ankle to the fastener portions of the adjustable side straps.

4. The topless shoe of claim 3, wherein the strap behind the ankle is configured to be adjustably tightened.

5. The topless shoe of claim 1, wherein the side straps are configured to be adjustably tightened.

6. The topless shoe of claim 2, wherein the receiving portion and the coupling portion couple together via fasteners.

7. The topless shoe of claim 6, wherein the fasteners are hook and loop fasteners.

8. The topless shoe of claim 1, wherein the toe anchor points extend from an internal toe portion of the sole.

* * * * *